US012364284B2

(12) United States Patent
Zhou et al.

(10) Patent No.: US 12,364,284 B2
(45) Date of Patent: Jul. 22, 2025

(54) VAPORIZER AND ELECTRONIC VAPORIZATION DEVICE

(71) Applicant: SHENZHEN SMOORE TECHNOLOGY LIMITED, Guangdong (CN)

(72) Inventors: Weidong Zhou, Shenzhen (CN); Fengwen Lu, Shenzhen (CN); Min Wang, Shenzhen (CN); Xiaogang Deng, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 541 days.

(21) Appl. No.: 17/750,621

(22) Filed: May 23, 2022

(65) Prior Publication Data

US 2022/0279856 A1 Sep. 8, 2022
US 2023/0000161 A9 Jan. 5, 2023

Related U.S. Application Data

(63) Continuation of application No. PCT/CN2020/132436, filed on Nov. 27, 2020.

(30) Foreign Application Priority Data

Nov. 25, 2019 (CN) ..... 201922075128.5

(51) Int. Cl.
*A24F 40/465* (2020.01)
*A24F 40/10* (2020.01)
*A24F 40/485* (2020.01)

(52) U.S. Cl.
CPC ..... *A24F 40/465* (2020.01); *A24F 40/10* (2020.01); *A24F 40/485* (2020.01)

(58) Field of Classification Search
None
See application file for complete search history.

(56) References Cited

U.S. PATENT DOCUMENTS

2015/0090280 A1* 4/2015 Chen ..... A61M 15/06 131/329
2019/0037920 A1 2/2019 Qiu

FOREIGN PATENT DOCUMENTS

CN 108354235 A 8/2018
CN 108778384 A 11/2018
(Continued)

OTHER PUBLICATIONS

English machine translation of CN 204599327 U; to Liu; 44 pages; published Sep. 2, 2015; (Year: 2015).*
(Continued)

*Primary Examiner* — Linda L Gray
(74) *Attorney, Agent, or Firm* — Leydig, Voit & Mayer, Ltd.

(57) ABSTRACT

A vaporizer includes: a base having a first cavity, and, on a bottom wall of the base, two electrode holes in communication with the first cavity; a vaporization core having a first electrode wire and a second electrode wire and mounted in the first cavity; and a first magnetic electrode and a second magnetic electrode. The first magnetic electrode is assembled in a first electrode hole of the two electrode holes and in contact with the first electrode wire electrically connectable to the first electrode wire. The second magnetic electrode is assembled in a second electrode hole of the two electrode holes and in contact with the second electrode wire electrically connectable to the second electrode wire.

18 Claims, 11 Drawing Sheets

(56) References Cited

FOREIGN PATENT DOCUMENTS

| | | | |
|---|---|---|---|
| CN | 110250577 | A | 9/2019 |
| CN | 209420953 | U | 9/2019 |
| CN | 110403241 | A | 11/2019 |
| CN | 209628635 | U | 11/2019 |
| CN | 209768986 | U | 12/2019 |
| CN | 211746997 | U | 10/2020 |
| CN | 211861815 | U | 11/2020 |
| WO | 2018086011 | A1 | 5/2018 |

OTHER PUBLICATIONS

Patent Cooperation Treaty, International Search Report, International Application No. PCT/CN2020/132436 (Mar. 8, 2021).
Patent Cooperation Treaty, Written Opinion of the International Searching Authority, International Application No. PCT/CN2020/132436 (Mar. 8, 2021).

* cited by examiner

VAPORIZER AND ELECTRONIC VAPORIZATION DEVICE

CROSS-REFERENCE TO PRIOR APPLICATION

This application is a continuation of International Patent Application No. PCT/CN2020/132436, filed on Nov. 27, 2020, which claims priority to Chinese Patent Application No. CN 201922075128.5, filed on Nov. 25, 2019. The entire disclosure of both applications is hereby incorporated by reference herein.

FIELD

This application relates to the field of electronic vaporization technologies, and in particular, to a vaporizer and an electronic vaporization device.

BACKGROUND

In the related art, an electronic vaporization device mainly includes a vaporizer and a body component. The vaporizer generally includes a liquid storage cavity and a vaporization component, where the liquid storage cavity is configured to store a vaporizable medium, and the vaporization component is configured to heat and vaporize the vaporizable medium, to form vapor for an inhaler to inhale. The body component is configured to supply power to the vaporizer.

In an existing vaporizer, a manner in which an electrode of a vaporization core passes through to the outside to be electrically connected to the body component is relatively complex, leading to a relatively high assembly difficulty and a complicated process of the vaporizer.

SUMMARY

In an embodiment, the present invention provides a vaporizer, comprising: a base comprising a first cavity, and, on a bottom wall of the base, two electrode holes in communication with the first cavity; a vaporization core comprising a first electrode wire and a second electrode wire and mounted in the first cavity; and a first magnetic electrode and a second magnetic electrode, wherein the first magnetic electrode is assembled in a first electrode hole of the two electrode holes and in contact with the first electrode wire electrically connectable to the first electrode wire, and wherein the second magnetic electrode is assembled in a second electrode hole of the two electrode holes and in contact with the second electrode wire electrically connectable to the second electrode wire.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
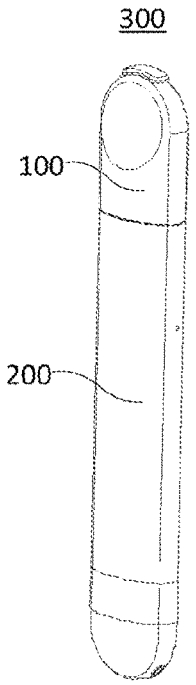
FIG. 1 is a schematic structural diagram of an embodiment of an electronic vaporization device according to this application.

In an embodiment, the present invention provides a vaporizer and an electronic vaporization device, to resolve problems of a relatively high assembly difficulty and a complicated process of the vaporizer caused by a relatively complex manner in which an electrode of a vaporization core in the vaporizer passes through to the outside to be electrically connected to a body component.

In an embodiment, the present invention provides a vaporizer. The vaporizer includes: a base, including a first cavity, where two electrode holes in communication with the first cavity are provided on a bottom wall of the base; a vaporization core, including a first electrode wire and a second electrode wire and mounted in the first cavity; and a first magnetic electrode and a second magnetic electrode, where the first magnetic electrode is assembled in one electrode hole and in contact with the first electrode wire to be electrically connected to the first electrode wire, and the second magnetic electrode is assembled in the other electrode hole and in contact with the second electrode wire to be electrically connected to the second electrode wire.

In some embodiments, the vaporizer further includes a holder, the holder is mounted in the first cavity, the holder includes a second cavity, an avoidance groove is provided on two sides of the holder respectively, the avoidance groove is provided corresponding to the electrode hole, two wiring channels are provided on the holder, and the wiring channel communicates the second cavity and the corresponding avoidance groove; and the vaporization core is located in the second cavity, the first electrode wire and the second electrode wire respectively pass through the corresponding wiring channels to enter the avoidance grooves and are attached to side walls of the avoidance grooves, the first magnetic electrode tightly presses the first electrode wire on the side wall of the corresponding avoidance groove, and the second magnetic electrode tightly presses the second electrode wire on the side wall of the corresponding avoidance groove.

In some embodiments, a vent hole in communication with the first cavity is provided on the bottom wall of the base, and a mounting opening relative to the vent hole is provided on a bottom wall of the holder; and the vaporizer further includes an air inlet member, the air inlet member is provided with a plurality of run-through air inlet holes, the air inlet member is clamped between the bottom wall of the base and the bottom wall of the holder, the plurality of air inlet holes are provided corresponding to the mounting opening, and a diameter of the air inlet hole is less than a diameter of the vent hole.

In some embodiments, the air inlet member includes an air inlet top wall, an air guide side wall, and a flange, the air inlet top wall is provided with the plurality of air inlet holes, the air guide side wall surrounds and is connected to a periphery of the air inlet top wall, the air guide side wall passes through the mounting opening and enables the air inlet top wall to protrude from the bottom wall of the holder, the flange is connected to a periphery of the air guide side wall and extends outward, and the flange is clamped between the bottom wall of the base and the bottom wall of the holder.

In some embodiments, a first buffer groove is provided on the bottom wall of the base, and the first buffer groove is provided surrounding the vent hole; and the vaporizer further includes a liquid absorbing member, the liquid absorbing member is pressed by the holder and disposed in the first buffer groove, and the liquid absorbing member is disposed surrounding the flange and in contact with the flange.

In some embodiments, a second buffer groove is further provided on the bottom wall of the base, and the second buffer groove is provided at a bottom wall of the first buffer groove.

In some embodiments, a receiving groove is further provided on the bottom wall of the base, and the receiving groove is provided corresponding to the mounting opening and configured to receive liquid leaked from the air inlet hole.

In some embodiments, the vaporizer further includes: a vaporization sleeve, including a liquid storage cavity; and a mounting base, including a first pressure regulating channel and a liquid inlet cavity, where the first pressure regulating channel is circuitously provided at a periphery of the liquid inlet cavity, the mounting base is embedded in the liquid storage cavity, the first pressure regulating channel and the liquid inlet cavity are both in communication with the liquid storage cavity, and the first pressure regulating channel is in communication with air; and the vaporization core is further connected to one end of the mounting base away from the liquid storage cavity and blocks the liquid inlet cavity.

In some embodiments, the base sealedly covers on one end of the vaporization sleeve and is connected to the mounting base, the base includes a second pressure regulating channel, the second pressure regulating channel is circuitously provided, the second pressure regulating channel is in communication with the first pressure regulating channel, and the second pressure regulating channel is in communication with the second cavity.

In order to resolve the technical problem, another technical solution adopted by this application is to provide an electronic vaporization device. The electronic vaporization device includes a body component and the vaporizer described above, and the body component is connected to the vaporizer and supplies power to the vaporizer.

Beneficial effects of this application are as follows: different from the related art, this application discloses a vaporizer and an electronic vaporization device. In this application, electrode holes are provided on a base, and a vaporization core is mounted in a first cavity of the base, so that a first magnetic electrode is in contact with a first electrode wire when assembled in a corresponding electrode hole to implement electrical connection between the first magnetic electrode and the first electrode wire, and a second magnetic electrode is in contact with a second electrode wire when assembled in a corresponding electrode hole to implement electrical connection between the second magnetic electrode and the second electrode wire. That is, when the first magnetic electrode and the second magnetic electrode are assembled in corresponding electrode holes, the electrical connection between the first magnetic electrode and the first electrode wire and the electrical connection between the second magnetic electrode and the second electrode wire may be implemented. Therefore, a structure that an electrode of a vaporization core passes through to the outside of the vaporizer is simplified, so that a mounting process of the vaporizer is simplified, thereby reducing the assembly difficulty of the vaporizer and improving the assembly efficiency of the vaporizer.

The technical solutions in embodiments of this application are clearly and completely described below with reference to the accompanying drawings in the embodiments of this application. Apparently, the described embodiments are merely some rather than all of the embodiments of this application. All other embodiments obtained by a person of ordinary skill in the art based on the embodiments of this application without creative efforts shall fall within the protection scope of this application.

The terms "first", "second", and "third" are merely intended for a purpose of description, and shall not be understood as an indication or implication of relative importance or implicit indication of the number of indicated technical features. Therefore, features defining "first", "second", and "third" can explicitly or implicitly include at least one of the features. In description of this application, "a plurality of" means at least two, such as two and three unless it is specifically defined otherwise. In addition, the terms "include", "have", and any variant thereof are intended to cover a non-exclusive inclusion. For example, a process, method, system, product, or device that includes a series of steps or units is not limited to the listed steps or units; and instead, further optionally includes a step or unit that is not listed, or further optionally includes another step or unit that is intrinsic to the process, method, product, or device.

Embodiment mentioned in the specification means that particular features, structures, or characteristics described with reference to the embodiment may be included in at least one embodiment of this application. The term appearing at different positions of this specification may not refer to the same embodiment or an independent or alternative embodiment that is mutually exclusive with another embodiment. A person skilled in the art explicitly or implicitly understands that the embodiments described in this specification may be combined with other embodiments.

Figure 2:
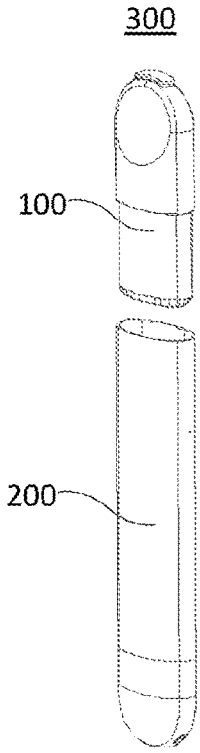
FIG. 2 is a schematic diagram of separation of a vaporizer and a body component in the electronic vaporization device in FIG. 1.
Figure 3:
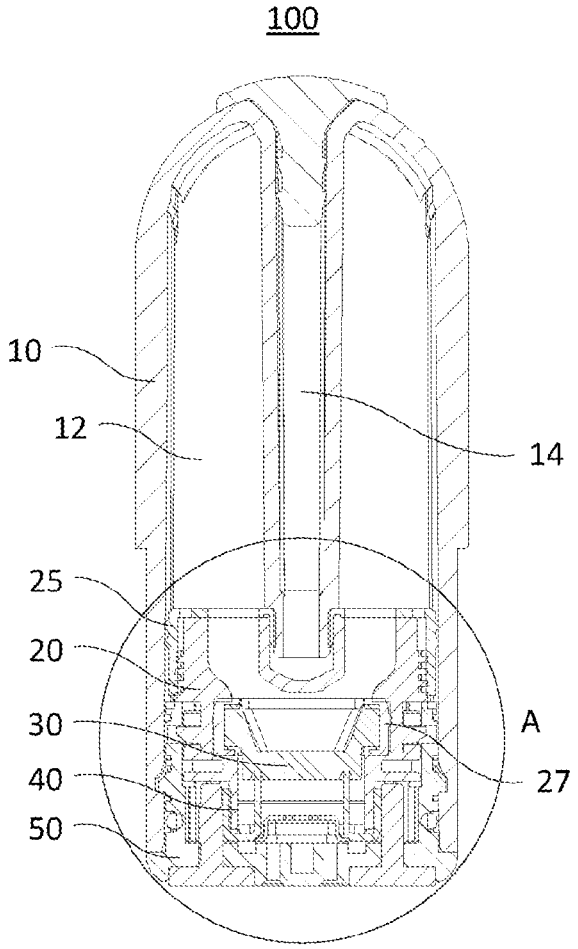
FIG. 3 is a schematic cross-sectional view of a vaporizer in FIG. 1.
Figure 4:
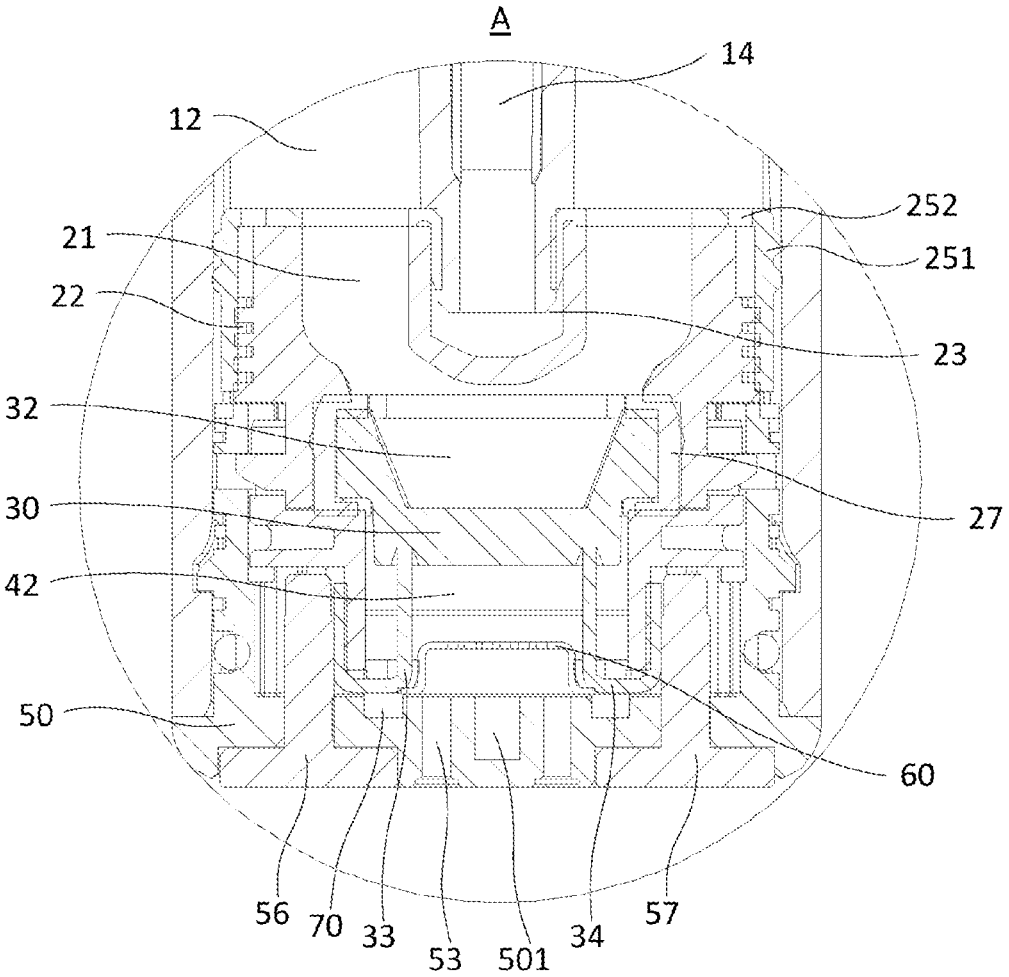
FIG. 4 is a schematic enlarged view of a region A in FIG. 3.

This application provides an electronic vaporization device 300. Referring to FIG. 1 to FIG. 4, FIG. 1 is a schematic structural diagram of an embodiment of the electronic vaporization device according to this application, FIG. 2 is a schematic diagram of separation of a vaporizer and a body component in the electronic vaporization device in FIG. 1, FIG. 3 is a schematic cross-sectional view of a vaporizer in FIG. 1, and FIG. 4 is a schematic enlarged view of a region A in FIG. 3.

The electronic vaporization device 300 may be used for vaporization of liquid substrates such as e-liquid and medicinal liquid. The electronic vaporization device 300 includes a vaporizer 100 and a body component 200 that are connected to each other. The vaporizer 100 is configured to store a liquid substrate and vaporize the liquid substrate to form vapor that can be inhaled by a user, and the body component 200 is configured to supply power to the vaporizer 100, so that the vaporizer 100 can vaporize the liquid substrate to form vapor.

Generally, the vaporizer 100 includes a vaporization sleeve 10, a mounting base 20, a vaporization core 30, a holder 40, and a base 50.

The vaporization sleeve 10 includes a liquid storage cavity 12, a vent tube 14 is disposed in the vaporization sleeve 10, the liquid storage cavity 12 is configured to store the liquid substrate, and the vent tube 14 is configured to guide vapor to a mouth of the user.

The mounting base 20 includes a first pressure regulating channel 22, a liquid inlet cavity 21, and a vapor outlet 23. The first pressure regulating channel 22 is circuitously provided at a periphery of the liquid inlet cavity 21, the mounting base 20 is embedded in the vaporization sleeve 10, the first pressure regulating channel 22 and the liquid inlet cavity 21 are both in communication with the liquid storage cavity 12, and the liquid inlet cavity 21 guides the liquid substrate to the vaporization core 30, so that the vaporization core 30 vaporizes the liquid substrate to form vapor, and the vent tube 14 is connected to the vapor outlet 23, to guide the vapor to an oral cavity of the user through the vapor outlet 23.

The vaporization core 30 is connected to one end of the mounting base 20 away from the liquid storage cavity 12 and blocks the liquid inlet cavity 21, so that the vaporization sleeve 10, the mounting base 20, and the vaporization core 30 form a liquid storage space. After the liquid substrate is stored in the liquid storage space, the liquid substrate liquid seals the first pressure regulating channel 22.

When an outer air pressure changes or the balance between an air pressure in the liquid storage cavity 12 and the outer air pressure is lost due to inhalation, for example, when the air pressure in the liquid storage cavity 12 is excessively large, the liquid substrate may leak between the mounting base 20 and an inner wall of the vaporization sleeve 10, or the liquid substrate may leak from the vaporization core 30, or the liquid substrate may leak from a joint between the vaporization core 30 and the mounting base 20.

Alternatively, when the air pressure in the liquid storage cavity 12 is excessively low, due to the influence of air pressure difference between the inside and the outside of the liquid storage cavity 12, liquid flowing of the liquid substrate may be not smooth, and the vaporization core 30 may generate a burnt flavor during operation due to insufficient liquid supplying, leading to poor inhalation experience to the user.

Therefore, when the air pressure inside and outside the liquid storage cavity 12 is imbalanced, the first pressure regulating channel 22 adaptively adjust an amount of the liquid substrate stored therein or supply air to the liquid storage cavity 12 according to the air pressure difference between the inside and the outside of the liquid storage cavity 12, to further adjust the air pressure in the liquid storage cavity 12, so that the air pressure in the liquid storage cavity 12 maintains dynamic balance with a normal air pressure.

It should be noted that, a size of the first pressure regulating channel 22 is relatively small. When the liquid substrate is located in the first pressure regulating channel 22, a surface of the first pressure regulating channel 22 has surface tension on the liquid substrate, and the liquid substrate liquid seals the first pressure regulating channel 22 from the inside of the liquid storage cavity 12, so that a part that is not filled by the liquid substrate in the liquid storage cavity 12 form a confined space. An air pressure in the confined space and the surface tension of the first pressure regulating channel 22 on the liquid substrate enable the liquid substrate not to directly leak from the first pressure regulating channel 22 to some extent, so that the liquid substrate is not lost, and a possibility that the liquid substrate leaks out of the vaporizer is also reduced.

Further, the first pressure regulating channel 22 is circuitously provided at a periphery of the liquid inlet cavity 21, and a channel length of the first pressure regulating channel 22 may be set to a relatively great value to store the liquid substrate as much as possible, thereby facilitating to reduce a risk that liquid substrate leaks from the first pressure regulating channel 22, and facilitating the first pressure regulating channel 22 to adaptively adjust the air pressure in the liquid storage cavity 12.

Therefore, when the air pressure in the liquid storage cavity 12 and the normal air pressure are imbalanced, and the air pressure in the liquid storage cavity 12 is greater than a balanced air pressure, the liquid substrate in the liquid storage cavity enters the first pressure regulating channel 22 due to the air pressure difference, so that the air pressure in the liquid storage cavity 12 is reduced until a state of air pressure balance between the inside and the outside is restored. When the air pressure in the liquid storage cavity 12 is imbalanced, and the air pressure in the liquid storage cavity 12 is less than the balanced air pressure, the liquid substrate stored in the first pressure regulating channel 22 enters the liquid storage cavity 12 again due to the air pressure difference, and further, airflow enters the liquid storage cavity 12 from the first pressure regulating channel 22, to increase the air pressure in the liquid storage cavity 12 until the state of air pressure balance between the inside and the outside is restored. Therefore, the amount of the liquid substrate stored in the first pressure regulating channel 22 may adaptively adjust due to the air pressure difference between the inside and the outside, and external airflow may further enter the liquid storage cavity 12 through the first pressure regulating channel 22, so that the air pressure in the liquid storage cavity 12 and the normal air pressure maintain dynamic balance, thereby effectively reducing risks of liquid leakage and non-smooth liquid flowing of the vaporizer 100.

The balanced air pressure is an air pressure value when the air pressure in the liquid storage cavity 12 and the normal air pressure are balanced.

In this embodiment of this application, the vaporization sleeve 10 is configured to have the liquid storage cavity 12, and the mounting base 20 is disposed in the vaporization sleeve 10 to block the liquid storage cavity 12, and the liquid inlet cavity 21 provided on the mounting base 20 guides the liquid substrate in the liquid storage cavity 12 to the vaporization core 30, so that the vaporization sleeve 10, the mounting base 20, and the vaporization core 30 form a liquid storage space. The first pressure regulating channel 22 provided on the mounting base 20 is in communication with air, after the liquid substrate liquid seals the first pressure regulating channel 22, the amount of the liquid substrate stored in the first pressure regulating channel 22 adaptively adjusts according to the air pressure difference between the air pressure in the liquid storage cavity 12 and the normal air pressure. In addition, the external airflow may further enter the liquid storage cavity 12 through the first pressure regulating channel 22 due to the air pressure difference between the inside and the outside of the liquid storage cavity 12, so that the air pressure in the liquid storage cavity 12 and the normal air pressure maintain dynamic balance, and occurrence of liquid leakage or non-smooth liquid flowing caused by the excessively large air pressure in the liquid storage cavity 12 may be avoided, thereby effectively improving the performance of the vaporizer and improving the quality of the vaporizer.

In some implementations, the first pressure regulating channel 22 may be a channel inside the mounting base 20, an inlet of the first pressure regulating channel 22 is located on one end of the mounting base 20 facing the liquid storage cavity 12, and an outlet of the first pressure regulating channel 22 is located on one end of the mounting base 20 away from the liquid storage cavity 12.

Figure 6:
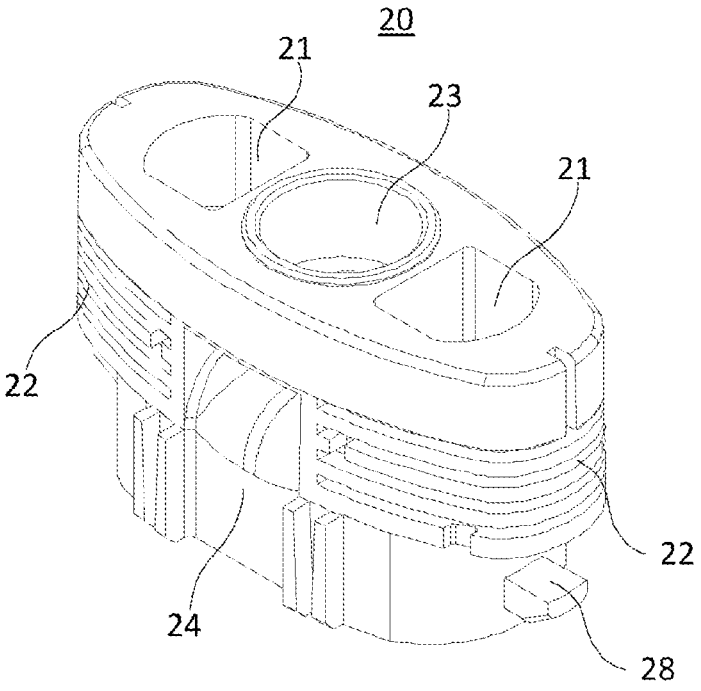
FIG. 6 is a schematic structural diagram of a mounting base in FIG. 3.
Figure 7:
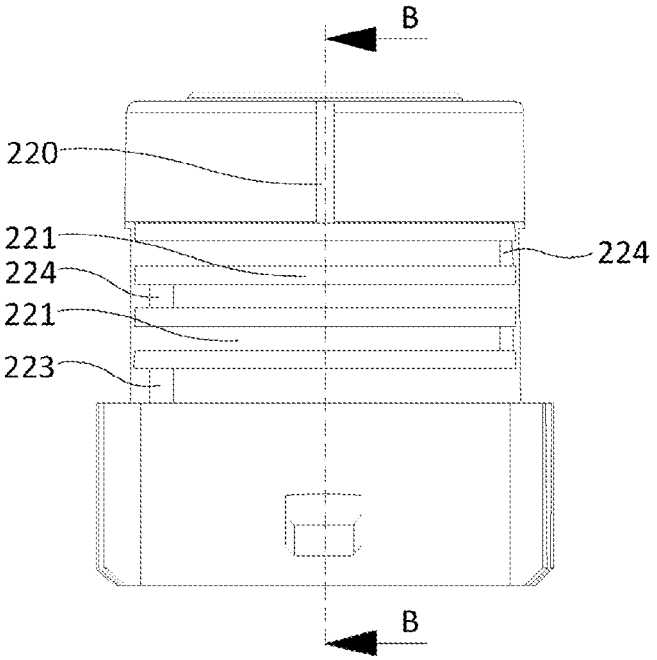
FIG. 7 is a schematic side structural view of the mounting base in FIG. 6.
Figure 8:
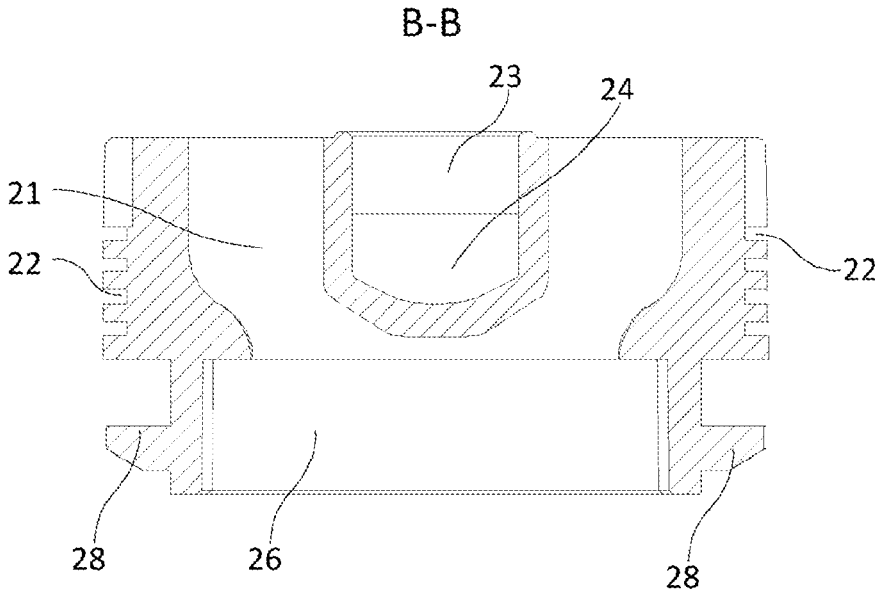
FIG. 8 is a schematic structural cross-sectional view of the mounting base in FIG. 7.

In this embodiment, as shown in FIG. 6 to FIG. 8, the first pressure regulating channel 22 is provided on a surface of the side wall of the mounting base 20, and the first pressure regulating channel 22 includes a liquid inlet groove 220, a liquid storage groove 221, and a vent groove 223 that are in communication with each other sequentially. A plurality of liquid storage grooves 221 are arranged on the side wall of the mounting base 20 in an embedding direction of the mounting base 20 facing the liquid storage cavity 12, the plurality of liquid storage grooves 221 are in communication with each other, the liquid inlet groove 220 communicates the liquid storage cavity 12 with a liquid storage groove 221 close to the liquid storage cavity 12, and the vent groove 223 communicates the liquid storage groove 221 with air.

The liquid substrate enters the liquid storage groove 221 from the liquid inlet groove 220, the plurality of liquid storage grooves 221 are arranged in parallel in the embedding direction of the mounting base 20 facing the liquid storage cavity 12, and the plurality of liquid storage grooves 221 are in communication with each other. Therefore, an entire length of the first pressure regulating channel 22 may be greatly increased, namely, a path that the liquid substrate flows out of the first pressure regulating channel 22 is increased, thereby facilitating the first pressure regulating channel 22 to adaptively adjust the air pressure in the liquid storage cavity 12.

Specifically, two adjacent liquid storage grooves 221 are in communication through a notch 224, and adjacent notches 224 are respectively located on two ends of a liquid storage groove 221, so that a liquid storage space of a single liquid storage groove 221 is utilized to the greatest extent.

A length of the liquid storage groove 221 in the embedding direction of the mounting base 20 facing the liquid storage cavity 12 is 0.2 mm to 0.5 mm. A width size of the liquid storage groove 221 has relatively strong surface tension on the liquid substrate stored in the liquid storage groove, which facilitates to slow the flowing of the liquid substrate along the liquid storage groove 221, so that the liquid substrate can hardly flow out from the first pressure regulating channel 22. Therefore, liquid leakage is slowed, and the first pressure regulating channel 22 can adaptively adjust the air pressure in the liquid storage cavity 12.

For example, the width of the liquid storage groove 221 in the embedding direction of the mounting base 20 facing the liquid storage cavity 12 may be 0.2 mm, 0.3 mm, 0.4 mm, or 0.5 mm.

The liquid inlet groove 220 is distributed in the embedding direction of the mounting base 20 facing the liquid storage cavity 12 and is in communication with the liquid storage groove 221, and a width of the liquid inlet groove 220 in a circumferential direction of the mounting base 20 is 0.3 mm to 0.6 mm. A width size of the liquid inlet groove 220 facilitates the liquid substrate to enter the liquid storage groove 221 from the liquid inlet groove 220, so that the first pressure regulating channel 22 can adaptively adjust the air pressure in the liquid storage cavity 12.

For example, the width of the liquid inlet groove 220 in the circumferential direction of the mounting base 20 may be 0.3 mm, 0.4 mm, 0.5 mm, or 0.6 mm. Optionally, the liquid inlet groove 220, the liquid storage groove 221, and the vent groove 223 may abut against a side wall of the liquid storage cavity 12 to form a channel for storing the liquid substrate. For example, the mounting base 20 may be made of a material with certain elasticity, so that a sealed connection may be implemented between the mounting base 20 and the vaporization sleeve 10 when the mounting base 20 is embedded in the liquid storage cavity 12. In addition, the liquid inlet groove 220, the liquid storage groove 221, and the vent groove 223 engage with the side wall of the liquid storage cavity 12 to form the first pressure regulating channel 22.

Figure 5:
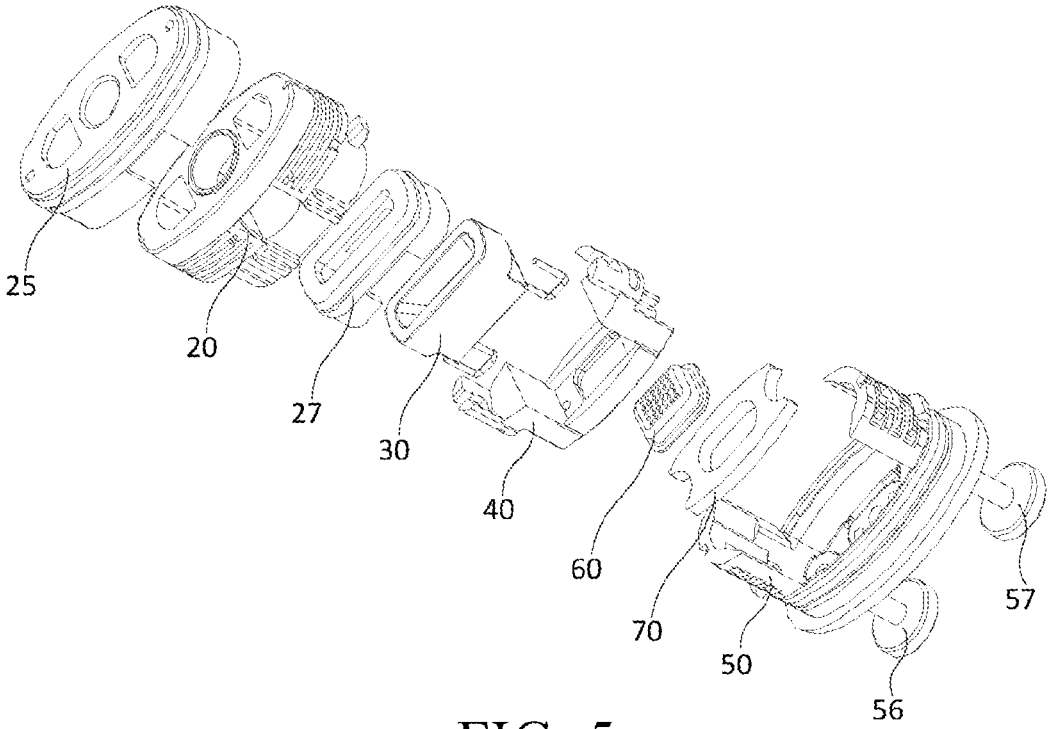
FIG. 5 is a schematic exploded view of components in a vaporization sleeve in the vaporizer in FIG. 3.

In this embodiment, as shown in FIG. 3 to FIG. 5, the vaporizer 100 further includes a first seal member 25, and the first seal member 25 is sleeved on one end of the mounting base 20 facing the liquid storage cavity 12.

Figure 9:
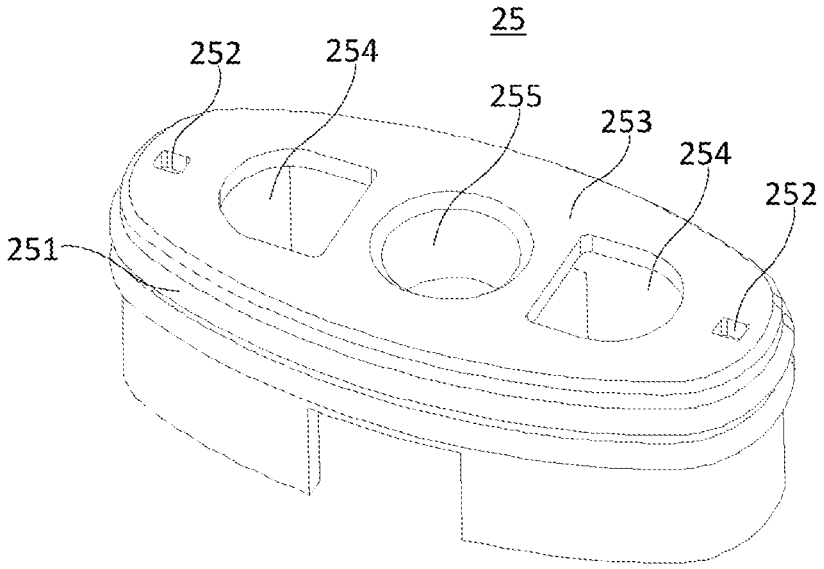
FIG. 9 is a schematic structural diagram of a first seal member in FIG. 3.

As shown in FIG. 9, the first seal member 25 includes a side wall seal portion 251, an end surface cover portion 253, and a sleeve seal portion 255. The side wall seal portion 251 is connected to an outer periphery of the end surface cover portion 253, the sleeve seal portion 255 is connected to an inner periphery of the end surface cover portion 253, and the side wall seal portion 251 and the sleeve seal portion 255 are spaced apart in a nested manner.

The end surface cover portion 253 is in a shape of a plate and is covered on one end of the mounting base 20 facing the liquid storage cavity 12, a first avoidance opening 252 and a second avoidance opening 254 are provided on the end surface cover portion 253, the first avoidance opening 252 corresponds to an end opening of the liquid inlet groove 220, and the second avoidance opening 254 corresponds to an end opening of the liquid inlet cavity 21.

The side wall seal portion 251 is in a shape of a sleeve, sleeved on the mounting base 20, disposed between the side wall of the mounting base 20 and the side wall of the vaporization sleeve 10, and blocks one side of the liquid inlet groove 220, the liquid storage groove 221, and the vent groove 223 facing the side wall of the vaporization sleeve 10 to form the first pressure regulating channel 22 through engagement, and seals a gap between the side wall of the mounting base 20 and the side wall of the vaporization sleeve 10.

The sleeve seal portion 255 is in a shape of a sleeve. The sleeve seal portion 255 is embedded in a vapor outlet 23, and a vent tube 14 is inserted into the vapor outlet 23. The sleeve seal portion 255 seals a gap between the vapor outlet 23 and the vent tube 14, to prevent e-liquid from penetrating into the vapor outlet 23 and prevent vapor from entering the liquid storage cavity 12.

In other implementations, the first seal member 25 may merely include the side wall seal portion 251, provided that sealing between the side wall of the mounting base 20 and the side wall of the vaporization sleeve 10 is implemented and the first pressure regulating channel 22 is formed through engagement with the liquid inlet groove 220, the liquid storage groove 221, and the vent groove 223.

As shown in FIG. 8, the mounting base 20 further includes an access cavity 26. The access cavity 26 is located on one end of the mounting base 20 away from the liquid storage cavity 12, the access cavity 26 is in communication with the liquid inlet cavity 21, and the access cavity 26 is configured to assemble the vaporization core 30.

Specifically, as shown in FIG. 4, FIG. 5, and FIG. 8, the vaporizer 100 further includes a second seal member 27. The second seal member 27 is sleeved on the vaporization core 30 and is embedded in the access cavity 26 along with the vaporization core 30. The second seal member 27 is configured to seal a gap between the mounting base 20 and the vaporization core 30 to prevent liquid from leaking from a joint between the mounting base 20 and the vaporization core 30, so that the connection between the mounting base 20 and the vaporization core 30 is tighter and is not easy to loose or fall off.

The vaporization core 30 further includes a groove 32. The groove 32 is in communication with the liquid inlet cavity 21, and the groove 32 is configured to increase a contact area between the vaporization core 30 and the liquid substrate and reduces a flow resistance of the liquid substrate reaching a bottom surface of the vaporization core 30, which facilitates to improve the liquid guidance and vaporization efficiency of the liquid substrate.

In some embodiments, the base 50 sealedly covers on one end provided with an opening of the vaporization sleeve 10 and engages with the mounting base 20 to fix the vaporization core 30.

Figure 10:
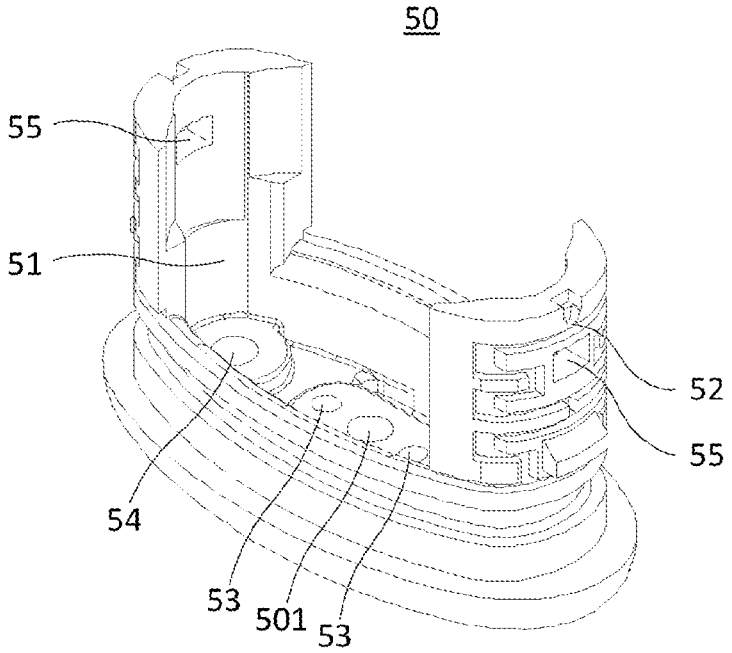
FIG. 10 is a schematic structural diagram of a base in FIG. 3.
Figure 11:
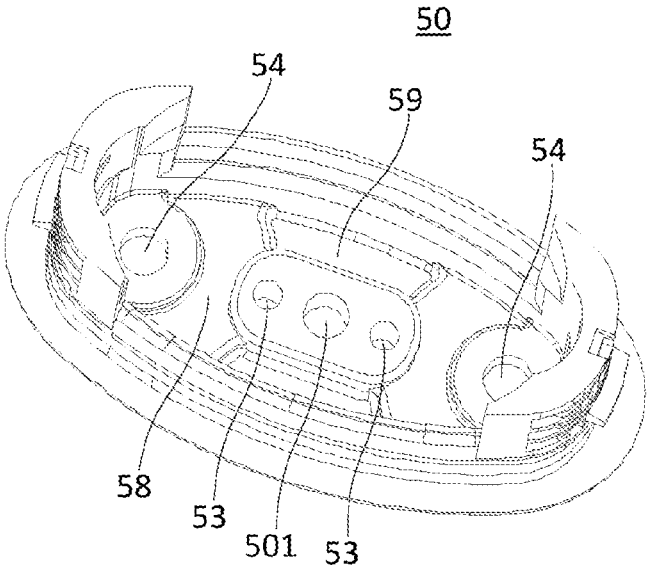
FIG. 11 is a schematic structural diagram of the base in FIG. 10 from another perspective.
Figure 12:
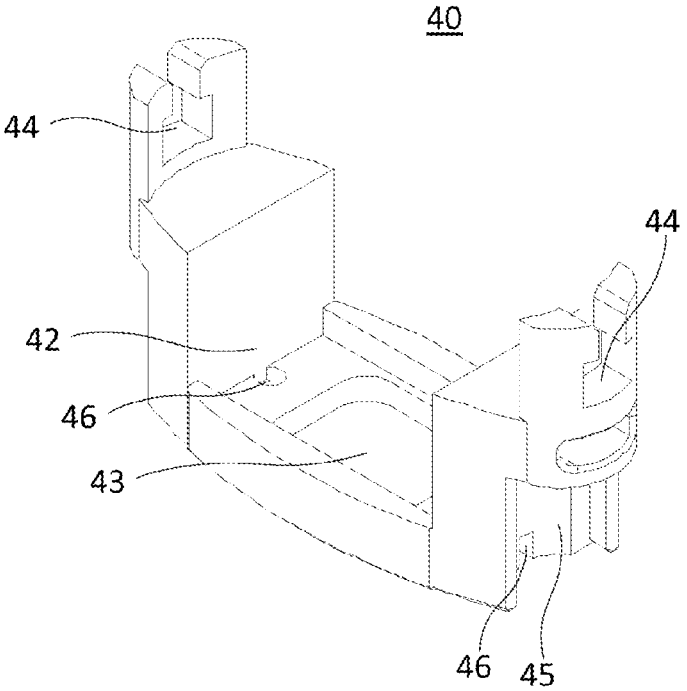
FIG. 12 is a schematic structural diagram of a holder in FIG. 3.

As shown in FIG. 10 and FIG. 11, the base 50 includes a first cavity 51, and a vent hole 53 in communication with the first cavity 51 is provided on a bottom wall of the base 50. The base 50 further blocks one side of the mounting base 20 and the vaporization core 30 away from the liquid storage cavity 12, so that the mounting base 20 and the base 50 are connected and engaged with each other to fix the vaporization core 30 between the mounting base 20 and the base 50, thereby preventing the vaporization core 30 from loosening. The vaporization core 30 vaporizes the liquid substrate to form vapor in the first cavity 51, and the vapor outlet 23 is in communication with the first cavity 51.

The base 50 further includes a second pressure regulating channel 52. The second pressure regulating channel 52 is circuitously provided to increase an extending length of the second pressure regulating channel 52 as much as possible, the second pressure regulating channel 52 is in communication with the first pressure regulating channel 22, and the second pressure regulating channel 52 is in communication with air. Therefore, if the liquid substrate flows out from the first pressure regulating channel 22, the liquid substrate may enter the second pressure regulating channel 52, to further reduce a risk that the liquid substrate leaks and improve the adaptive adjustment capability for the air pressure in the liquid storage cavity 12.

Specifically, the second pressure regulating channel 52 is in communication with the first cavity 51, and the first cavity 51 is in communication with external air through the vent hole 53. Therefore, with inhalation of an oral cavity of a person, the external air may be inhaled into the first cavity 51, and vapor enters the vent tube 14 from the first cavity 51 through the vapor outlet 23 and is finally inhaled into the oral cavity of the person.

In this embodiment, as shown in FIG. 3 to FIG. 5 and FIG. 12, the holder 40 is mounted in the first cavity 51, the holder 40 includes a second cavity 42, a mounting opening 43 relative to the vent hole 53 is provided on a bottom wall of the holder 40, and the second cavity 42 is in communication with the external air. The holder 40 is further connected to the mounting base 20 and engages with the mounting base to clamp and fix the vaporization core 30 and enable the vaporization core 30 to be located in the second cavity 42. The vaporization core 30 vaporizes the liquid substrate to form vapor in the second cavity 42, the vapor outlet 23 is in communication with the second cavity 42, and the second pressure regulating channel 52 is in communication with the second cavity 42.

Specifically, as shown in FIG. 6 and FIG. 8, the vapor outlet 23 is in communication with the second cavity 42 and the first cavity 51 through a vapor channel 24. The vapor channel 24 runs through the mounting base 20 and runs to the second cavity 42 and the first cavity 51 along two side walls of the mounting base 20. The first seal member 25 is disposed between the side wall of the mounting base 20 and the side wall of the liquid storage cavity 12, so that vapor may not enter the liquid storage cavity 12. In addition, a seal member such as a seal ring is further disposed between the base 50 and the vaporization sleeve 10, so that the vapor enters the vent tube 14 along with airflow from the second cavity 42 through the vapor channels 24 on two sides and the vapor outlet 23, and the seal member also prevents the liquid substrate from leaking to the outside of the vaporizer from the gap between the base 50 and the vaporization sleeve 10.

As shown in FIG. 6 to FIG. 12, the mounting base 20 further includes a barb 28, a first barb hole 44 is provided on the holder 40, a second barb hole 55 is provided on the base 50, and the barb 28 is connected to both the first barb hole 44 and the second barb hole 55 in a hooked manner.

Two electrode holes 54 in communication with the first cavity 51 are further provided on the bottom wall of the base 50, the holder 40 is mounted in the first cavity 51, and an avoidance groove 45 is respectively provided on two sides of the holder 40. The avoidance groove 45 is provided corresponding to the electrode hole 54, two wiring channels 46 are provided on the holder 40, and the wiring channel 46 communicates the second cavity 42 with a corresponding avoidance groove 45.

The wiring channel 46 may be provided on a bottom wall or a side wall of the second cavity 42, which is not limited in this application, provided that the wiring channel 46 communicates the second cavity 42 with the avoidance groove 45.

As shown in FIG. 4, the vaporization core 30 includes a first electrode wire 33 and a second electrode wire 34, the vaporization core 30 is mounted in the second cavity 42, and the first electrode wire 33 and the second electrode wire 34 respectively pass through corresponding wiring channels 46 to enter the avoidance grooves 45 and are attached to side walls of the avoidance grooves 45.

The vaporizer 100 further includes a first magnetic electrode 56 and a second magnetic electrode 57. The first magnetic electrode 56 is assembled in a corresponding electrode hole 54 to tightly press the first electrode wire 33 on the side wall of the avoidance groove 45, so that the first magnetic electrode 56 is electrically connected to the first electrode wire 33. The second magnetic electrode 57 is assembled in another electrode hole 54 to tightly press the second electrode wire 34 on the side wall of the avoidance groove 45, so that the second magnetic electrode 57 is electrically connected to the second electrode wire 34.

In this embodiment, the first magnetic electrode 56 and the second magnetic electrode 57 include both electrically conductive function and magnetic connection function, to ensure the electrical and magnetic connection with the body component 200, so that mounting holes and mounting elements between the vaporizer 100 and the body component 200 may be reduced, thereby simplifying a mounting process, reducing costs, and improving the efficiency.

In other implementations, the first magnetic electrode 56 and the second magnetic electrode 57 may further use common conductive electrodes, which are not limited in this application.

In some other implementations, the vaporizer 100 may be alternatively not provided with the holder 40.

For example, the base 50 includes a structure of the holder 40. Alternatively, the vaporization core 30 is mounted in the first cavity 51, and the first electrode wire 33 and the second electrode wire 34 are attached to the side wall of the base 50 or a groove wall of the base 50. Further, the first magnetic electrode 56 is assembled in a corresponding electrode hole 54, and the first magnetic electrode 56 is in contact with the first electrode wire 33 and tightly presses the first electrode wire 33 on the side wall or the groove wall of the base 50, so that the first magnetic electrode 56 is electrically connected to the first electrode wire 33. The second magnetic electrode 57 is assembled in another corresponding electrode hole 54, and the second magnetic electrode 57 is in contact with the second electrode wire 34 and tightly presses the second electrode wire 34 on the side wall or the groove wall of the base 50, so that the second magnetic electrode 57 is electrically connected to the second electrode wire 34.

The electrode holes 54 are provided on the base 50, the corresponding avoidance grooves 45 are provided on the holder 40, and the first electrode wire 33 and the second electrode wire 34 of the vaporization core 30 enters the avoidance grooves 45 through corresponding wiring channels 46 and are attached to the side walls of the avoidance grooves 45 respectively. Further, when assembled in the corresponding electrode hole 54, the first magnetic electrode 56 tightly presses the first electrode wire 33 on the side wall of the avoidance groove 45, and an electrical connection is implemented since the first magnetic electrode 56 is in contact with the first electrode wire 33. When assembled in the corresponding electrode hole 54, the second magnetic electrode 57 tightly presses the second electrode wire 34 on the side wall of the corresponding avoidance groove 45, and an electrical connection is implemented since the second magnetic electrode 57 is in contact with the second electrode wire 34. That is, when the first magnetic electrode 56 and the second magnetic electrode 57 are assembled in the corresponding electrode holes 54, the electrical connection between the first magnetic electrode 56 and the first electrode wire 33 and the electrical connection between the second magnetic electrode 57 and the second electrode wire 34 may be implemented. Therefore, the connection structure and the mounting process of the vaporization core 30 with the first magnetic electrode 56 and the second magnetic electrode 57 are simplified, and the assembly efficiency of the vaporizer 100 is improved.

Further, as shown in FIG. 4 and FIG. 5, the vaporizer 100 further includes an air inlet member 60, the air inlet member 60 is provided with a plurality of run-through air inlet holes 62, the air inlet member 60 is clamped between the bottom wall of the base 50 and the bottom wall of the holder 40, and the air inlet hole 62 is provided corresponding to the mounting opening 43, so that airflow enters the second cavity 42 from the vent hole 53 through the air inlet hole 62 and the mounting opening 43.

A diameter of the air inlet hole 62 is less than a diameter of the vent hole 53.

It should be noted that, a diameter size of the air inlet hole 62 is configured to have relatively great surface tension on the liquid substrate, to prevent the liquid substrate from flowing to the base 50 and flowing the body component 200 through the vent hole 53 of the base 50 after dripping to a region in which the air inlet hole 62 is located. In this way, occurrence of a situation that the liquid substrate drips to the body component 200 and damages electric elements in the body component 200 may be avoided.

In this embodiment of this application, the air inlet member 60 is clamped between the holder 40 and the base 50, the air inlet hole 62 of the air inlet member 60 is disposed corresponding to positions of the vent hole 53 and the mounting opening 43, and it is defined that the diameter of the air inlet hole 62 is less than the diameter of the vent hole 53, so that possible flowing of liquid existing in the second cavity 42 to the base 50 may be blocked, to further reduce a risk of liquid dripping of the base 50 and prevent the liquid dripping of the base 50 from damaging the body component 200.

As shown in FIG. 4 and FIG. 11, a receiving groove 501 is further provided on the bottom wall of the base 50, the receiving groove 501 is provided corresponding to the mounting opening 43, and the receiving groove 501 is configured to receive liquid leaked from the air inlet hole 62.

The receiving groove 501 is provided at a center position of the bottom wall of the base 50 and is located between the plurality of vent holes 53, which further facilitates to reduce a wall thickness of the base 50, to further prevent the bottom wall of the base 50 from being uneven during processing. In addition, the receiving groove 501 may further receive liquid leaked from the air inlet hole 62, to further reduce a risk that the liquid dripping of the base 50 damages the body component 200.

Figure 13:
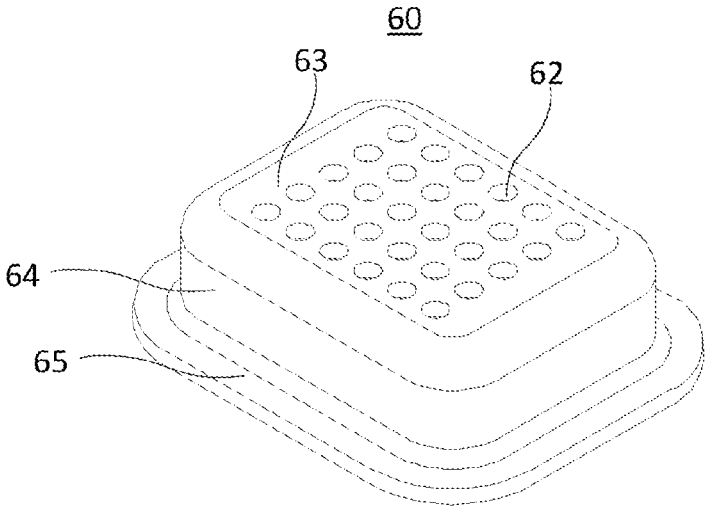
FIG. 13 is a schematic structural diagram of an air inlet member in FIG. 3.

As shown in FIG. 13, the air inlet member 60 includes an air inlet top wall 63, an air guide side wall 64, and a flange 65. A plurality of air inlet holes 62 are provided on the air inlet top wall 63, the air guide side wall 64 surrounds and is connected to a periphery of the air inlet top wall 63, the air guide side wall 64 passes through the mounting opening 43 and enables the air inlet top wall 63 to be away from the bottom wall of the base 50 and protrude from the bottom wall of the holder 40, the flange 65 is connected to a periphery of the air guide side wall 64 and extends outward, and the flange 65 is clamped between the bottom wall of the base 50 and the bottom wall of the holder 40.

A plurality of air inlet holes 62 are arranged on the air inlet top wall 63 in an array, for example, 5 rows and 6 columns air inlet holes 62 are arranged on the air inlet top wall 63. Two vent holes 53 are provided on the bottom wall of the base 50, a diameter size of the air inlet hole 62 is greater than a diameter size of the vent hole 53, and condensed liquid or leaked liquid falls onto the air inlet top wall 63 and finally falls off along the air guide side wall 64. In addition, the air inlet top wall 63 is away from the bottom wall of the base 50 and protrudes out of the bottom wall of the holder 40, so that droplets may be accumulated in the second cavity 42.

It should be noted that, various seal structures of the vaporizer 100 are all relatively perfect, so that an amount of the condensed liquid or leaked liquid flowing to the air inlet member 60 is limited, and a risk that the condensed liquid or leaked liquid falls from the base 50 to the outside of the vaporizer 100 and the body component 200 may be effectively reduced by disposing the air inlet member 60.

In other implementations, the air inlet member 60 may be in a shape of a plate and clamped between the holder 40 and the base 50.

As shown in FIG. 11, to prevent liquid from being accumulated in the second cavity 42, a first buffer groove 58 is further provided on the bottom wall of the base 50, and the first buffer groove 58 is provided surrounding the vent hole 53.

With reference to FIG. 4, FIG. 5, and FIG. 11, the vaporizer 100 further includes a liquid absorbing member 70. The liquid absorbing member 70 is pressed by the holder 40 and disposed in the first buffer groove 58, and the liquid absorbing member 70 is disposed surrounding the flange 65 and in contact with the flange 65. Therefore, droplets falling off along the air guide side wall 64 are finally absorbed and stored by the liquid absorbing member 70, to prevent the droplets from shaking in the holder 40 or the base 50, thereby further eliminating a risk that the droplets fall from the base 50 to the body component 200.

The liquid absorbing member 70 may be liquid absorbing cotton or liquid absorbing paper, which is not limited in this application provided that liquid may be absorbed.

A second buffer groove 59 is further provided on the bottom wall of the base 50, the second buffer groove 59 is provided at a bottom wall of the first buffer groove 58, and the liquid absorbing member 70 further seals the second buffer groove 59 when embedded in the first buffer groove 58. After the liquid stored in the liquid absorbing member 70 is saturated, the liquid may be further stored in the second buffer groove 59, thereby improving the liquid storage capability.

The vaporizer 100 is connected to the body component 200, and the body component 200 supplies power to the vaporizer 100, so that the vaporizer 100 can vaporize the liquid substrate to form vapor.

Figure 15:
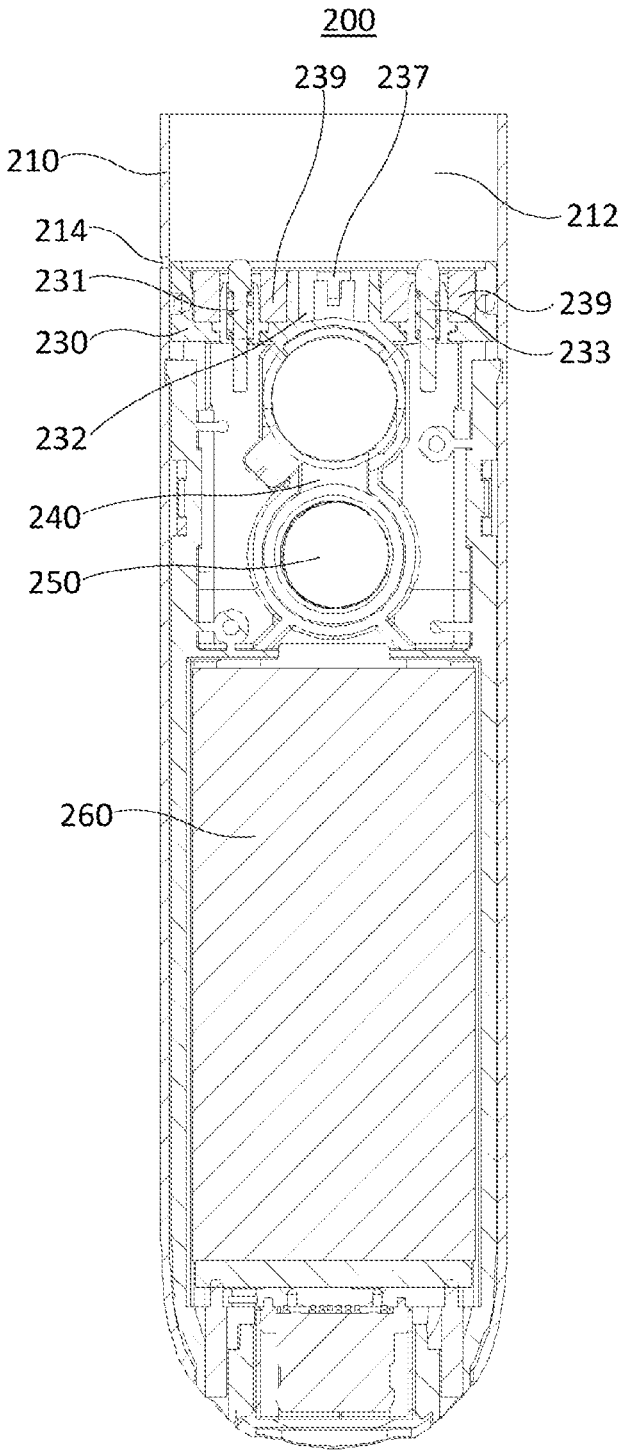
FIG. 15 is a schematic cross-sectional view of a body component in FIG. 1.

As shown in FIG. 15, the body component 200 generally includes a housing 210, a base 230, a fixing member 240, an airflow sensor 250, and a battery 260.

Figure 14:
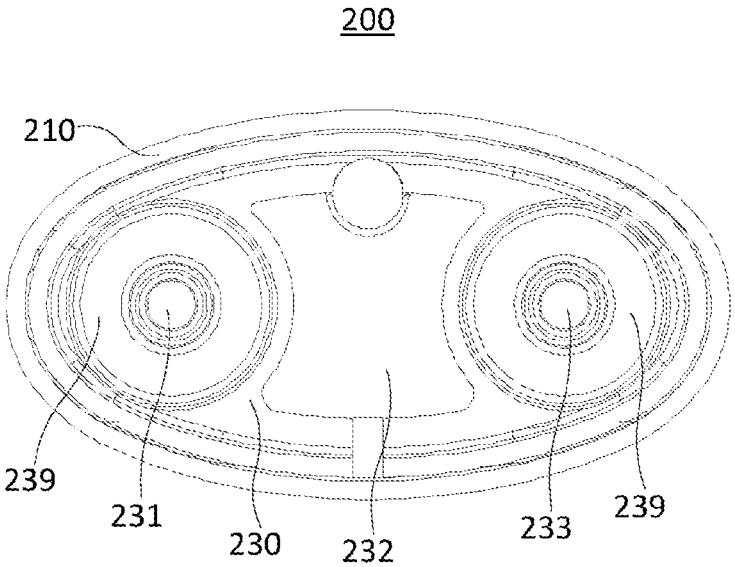
FIG. 14 is a schematic top view of a body component in FIG. 1.
Figure 16:
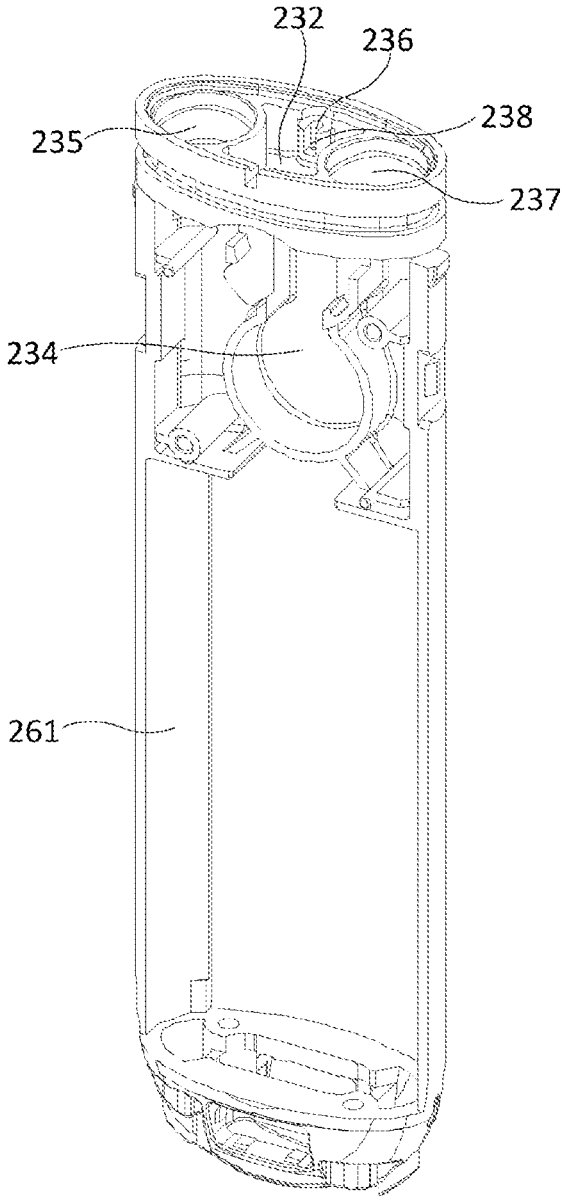
FIG. 16 is a schematic structural diagram of a base in the body component in FIG. 15.
Figure 17:
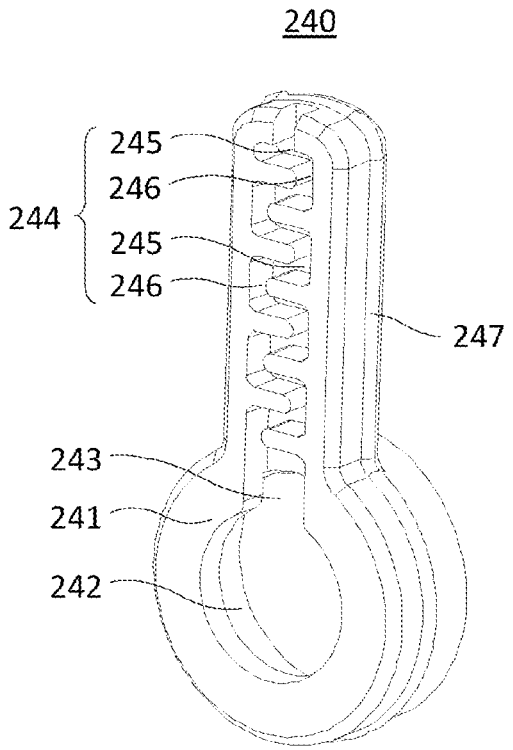
FIG. 17 is a schematic structural diagram of a fixing member in the body component in FIG. 15.
Figure 18:
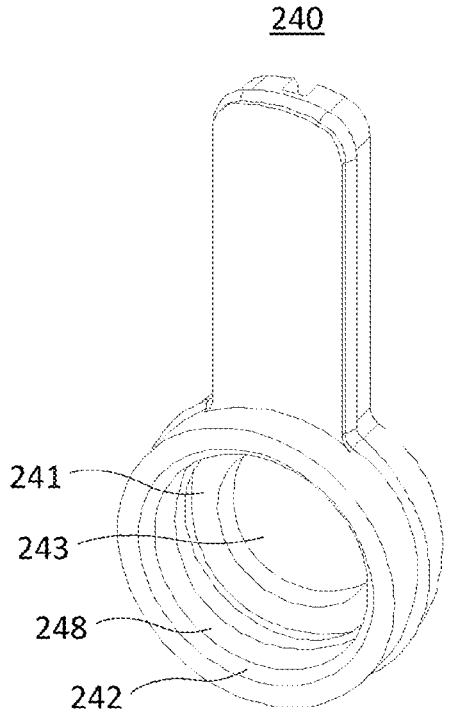
FIG. 18 is a schematic structural diagram of the fixing member in FIG. 17 from another perspective.

Referring to FIG. 14 to FIG. 16, the housing 210 includes an accommodating cavity 212, the base 230 is located in the housing 210, and the battery 260 is disposed in the accommodating cavity 212 and on one side of the base 230 away from the vaporizer 100. A first elastic electrode 231 and a second elastic electrode 233 are disposed on the base 230, a magnetic member 239 is sleeved on both a periphery of the first elastic electrode 231 and a periphery of the second elastic electrode 233, the battery 260 is electrically connected to the first elastic electrode 231 and the second elastic electrode 233, the first elastic electrode 231 abuts against the first magnetic electrode 56, and the second elastic electrode 233 abuts against the second magnetic electrode 57.

Specifically, a first groove 235 and a second groove 237 are further provided on the base 230, the first elastic electrode 231 is disposed in the first groove 235, the second elastic electrode 233 is disposed in the second groove 237, the magnetic members 239 are embedded in the first groove 235 and the second groove 237, and the two magnetic members 239 are respectively configured to absorb the first magnetic electrode 56 and the second magnetic electrode 57. When the magnetic member 239 absorbs the first magnetic electrode 56, the first elastic electrode 231 abuts against the first magnetic electrode 56; and when the magnetic member 239 absorbs the second magnetic electrode 57, the second elastic electrode 233 abuts against the second magnetic electrode 57.

An air inlet hole 214 is further provided on the housing 210, and the air inlet hole 214 is in communication with the accommodating cavity 212. The base 230 includes a vent cavity 232, the vent cavity 232 is provided on one side of the base 230 facing the vaporizer 100, the base 230 is disposed in the accommodating cavity 212, and the air inlet hole 214 is in communication with the vent cavity 232. When the vaporizer 100 is connected to the body component 200, the vent hole 53 is directly opposite to the vent cavity 232, so that external air enters the vent cavity 232 through the air inlet hole 214 and runs to the vent tube 14 through the vent hole 53.

It should be noted that, a battery assembly frame 261 is disposed on one side of the base 230 away from the vent cavity 232, and the battery assembly frame 261 is configured to load the battery 260.

As shown in FIG. 15 to FIG. 18, a mounting groove 234 is further provided on one side of the base 230 away from the vent cavity 232, an air guide hole 236 is further provided on the base 230, and the air guide hole 236 communicates the mounting groove 234 with the vent cavity 232.

The fixing member 240 is embedded in the mounting groove 234, and the fixing member 240 includes a fixing groove 242 and an airflow channel 244 circuitously provided, where one end of the airflow channel 244 is in communication with the air guide hole 214, and the other end of the airflow channel 244 is in communication with the fixing groove 242.

The airflow sensor 250 is embedded in the fixing groove 242, and the airflow sensor 250 is configured to detect airflow change situations in the vent cavity 232. That is, the airflow sensor 250 detects the airflow change situations in the vent cavity 232 through the airflow channel 244 and the air guide hole 214.

When a user inhales, the external air enters the vent cavity 232 through the air inlet hole 214 and runs to the vent tube 14 through the vent hole 53, to further cause air pressure changes in the vent cavity 232. If the airflow sensor 250 detects airflow change situations in the vent cavity 232, a signal may be sent to cause the body component 200 to supply power to the vaporizer 100, to facilitate the vaporizer 100 to vaporize the liquid substrate in time to generate vapor for the user to inhale.

In some other implementations, the fixing member 240 may be disposed in the housing 210 in another manner, one end of the airflow channel 244 is in communication with the air inlet hole 214, the airflow sensor 250 is connected to the fixing member 240, the airflow channel 244 communicates the air inlet hole 214 with the airflow sensor 250, and the airflow sensor 250 is configured to detect change situations of airflow entering the housing 210 through the air inlet hole 214.

For example, the fixing member 240 and the housing 210 are integrally formed, and one end of the airflow channel 244 is located in a flowing path of airflow entering from the air inlet hole 214, a mounting groove is provided on the housing 210, the airflow sensor 250 is assembled with the mounting groove and docked with the fixing member 240 to detect the change situations of the airflow through the airflow channel 244; or The fixing member 240 is connected to the housing 210 in a screwed, bonded, or clamped manner and docked with the fixing member 240, to detect the change situations of the airflow through the airflow channel 244.

Alternatively, the fixing member 240 is an independent individual, the fixing member 240 is screwed, bonded, or clamped to the housing 210, and one end of the airflow channel 244 is located at the air inlet hole 214, to facilitate the airflow sensor 250 to detect the airflow change situation at the air inlet hole 214; or one end of the airflow channel 244 is located in a flowing path of airflow entering from the air inlet hole 214, so that the airflow change situations in the electronic vaporization device may be also detected. The airflow sensor 250 may be screwed or clamped to the fixing member 240 and detect the airflow change situations through the airflow channel 244.

The air inlet hole 214 is provided on the housing 210, the vent cavity 232 is provided on one side of the base 230 facing the vaporizer 100, the mounting groove 234 is provided on one side of the base 230 away from the vent cavity 232, and the fixing member 240 to which the airflow sensor 250 is fixed is embedded in the mounting groove 234. The fixing member 240 includes the airflow channel 244 circuitously provided, and the airflow channel 244 communicates the vent cavity 232 with the airflow sensor 250, so that the airflow sensor 250 may detect the airflow change situations in the vent cavity 232. If the vent cavity 232 includes leaked liquid, the circuitously provided airflow channel 244 increases a difficulty that the leaked liquid flows to the airflow sensor 250, and the airflow channel 244 has surface tension on liquid, so that the airflow channel 244 may be not liquid sealed when a certain amount of leaked liquid enters the airflow channel 244, and the leaked liquid is easily scattered at various positions of the circuitously provided airflow channel 244, thereby preventing the leaked liquid entering the airflow channel 244 from directly falling to the airflow sensor 250 and also reducing a risk that the leaked liquid liquid seals the airflow channel 244.

The airflow channel 244 includes a plurality of first grooves 245 and a plurality of second grooves 246 that are disposed vertically. the plurality of first grooves 245 are arranged in parallel sequentially in an axial direction of the air guide hole 214, adjacent first grooves 245 are in communication with each other through a second groove 246, two ends of the second groove 246 are respectively connected to a head end or a tail end of two adjacent first grooves 245, and a head end and a tail end of the same first groove 245 are both connected to a second groove 246, so that the plurality of first grooves 245 and the plurality of second grooves 246 are in communication with each other sequentially. The fixing member 240 is embedded in the mounting groove 234, and the plurality of first grooves 245 and the plurality of second grooves 246 are further engaged with a bottom wall of the mounting groove 234 to form the circuitously provided airflow channel 244.

Liquid entering the airflow channel 244 is easily scattered in each first groove 245, thereby reducing a risk that the liquid is accumulated at a position to liquid seal the airflow channel 244.

In some implementations, the fixing groove 242 may be a groove, and the airflow channel 244 is in communication with the groove, so that the airflow sensor 250 is embedded in the fixing groove 242 and has a gap with a bottom wall of the fixing groove 242, and the airflow channel 244 is in communication with the gap.

In some other implementations, the fixing groove 242 may be a through groove, the airflow sensor 250 is embedded in the fixing groove 242 and has a gap with the bottom wall of the mounting groove 234, and the airflow channel 244 is in communication with the gap.

In this embodiment, the fixing groove 242 is a through groove, a block ring 241 is disposed on one side of the fixing groove 242 facing the mounting groove 234, the airflow sensor 250 is further blocked on the block ring 241, and a hollow portion 243 of the block ring 241 is in communication with the airflow channel 244. The airflow sensor 250 may be directly blocked on the block ring 241, so that the assembly convenience of the airflow sensor 250 with the fixing groove 242 is relatively improved.

A side wall of the air guide hole 236 located in the vent cavity 232 is provided with an opening 238, and the opening 238 is in communication with the vent cavity 232. The body component 200 further includes a block cover 237, the block cover 237 sealedly covers on one end of the air guide hole 236 located in the vent cavity 232, and the block cover 237 may block leaked liquid from directly falling into the air guide hole 236, thereby effectively reducing a risk that the leaked liquid enters the airflow channel 244.

An outer periphery of the fixing member 240 is provided with a first seal rib 247. When the fixing member 240 is embedded in the mounting groove 234, the first seal rib 247 is pressed and disposed on a side wall of the mounting groove 234, to implement a sealed connection between the fixing member 240 and the mounting groove 234. An inner periphery of the fixing groove 242 is provided with a second seal rib 248. When the airflow sensor 250 is embedded in the fixing groove 242, the second seal rib 248 is pressed and disposed on the airflow sensor 250, to implement a sealed connection between the airflow sensor 250 and the fixing groove 242.

Therefore, the mounting groove 234, the fixing member 240, and the airflow sensor 250 sequentially implement sealed engagement, and a risk that air leakage occurs at a connection gap between the components to affect a detection result of the airflow sensor 250 is eliminated, thereby helping improve the accuracy of the airflow sensor 250 in detecting the airflow change situations in the vent cavity 232 through the airflow channel 244.

Different from the related art, this application discloses a vaporizer and an electronic vaporization device. In this application, electrode holes are provided on a base, and a vaporization core is mounted in a first cavity of the base, so that a first magnetic electrode is in contact with a first electrode wire when assembled in a corresponding electrode hole to implement electrical connection between the first magnetic electrode and the first electrode wire, and a second magnetic electrode is in contact with a second electrode wire when assembled in a corresponding electrode hole to implement electrical connection between the second magnetic electrode and the second electrode wire. That is, when the first magnetic electrode and the second magnetic electrode are assembled in corresponding electrode holes, the electrical connection between the first magnetic electrode and the first electrode wire and the electrical connection between the second magnetic electrode and the second electrode wire may be implemented. Therefore, a structure that an electrode of a vaporization core passes through to the outside of the vaporizer is simplified, so that a mounting process of the vaporizer is simplified, thereby reducing the assembly difficulty of the vaporizer and improving the assembly efficiency of the vaporizer.

The foregoing descriptions are merely embodiments of this application, and the patent scope of this application is not limited thereto. All equivalent structure or process changes made according to the content of this specification and accompanying drawings in this application or by directly or indirectly applying this application in other related technical fields shall fall within the protection scope of this application.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A vaporizer, comprising:

a base comprising a first cavity, and, on a bottom wall of the base, a first electrode hole and a second electrode hole, both of which are in communication with the first cavity;

a vaporization core mounted in the first cavity, the vaporization core comprising a first electrode wire and a second electrode wire;

a first magnetic electrode and a second magnetic electrode; and a holder mounted in the first cavity, wherein the first magnetic electrode is assembled in the first electrode hole so as to be in contact with and press the first electrode wire against the base so that the first magnetic electrode is electrically connected to the first electrode wire, and wherein the second magnetic electrode is assembled in the second electrode hole so as to be in contact with and press the second electrode wire against the base so that the second magnetic electrode is electrically connected to the second electrode wire.

2. The vaporizer of claim 1, wherein the holder comprises a second cavity, wherein each side of two sides of the holder includes an avoidance groove, a first avoidance groove corresponding to the first electrode hole and a second avoidance groove corresponding to the second electrode hole, wherein holder comprises two wiring channels, wherein a first wiring channel of the two wiring channels communicates the second cavity and the first avoidance groove, and a second wiring channel of the two wiring channels communicates the second cavity and the second avoidance groove, wherein the vaporization core is located in the second cavity, wherein the first electrode wire passes through the first wiring channel to enter the first avoidance groove and is attached to a side wall of the first avoidance groove, wherein the second electrode wire passes through the second wiring channel to enter the second avoidance groove and is attached to a side wall of the second avoidance groove.

3. The vaporizer of claim 2, further comprising:

at least one vent hole on the bottom wall of the base, the vent hole being in communication with the first cavity;

a mounting opening on a bottom wall of the holder; and an air inlet member having a plurality of run-through air inlet holes, the air inlet member being clamped between the bottom wall of the base and the bottom wall of the holder, the plurality of air inlet holes corresponding to the mounting opening, wherein a diameter of each run-through air inlet hole of the plurality of run-through air inlet holes is less than a diameter of the vent hole.

4. The vaporizer of claim 3, wherein the air inlet member comprises:

an air inlet top wall;

an air guide side wall; and a flange, wherein the air inlet top wall comprises the plurality of run-through air inlet holes, wherein the air guide side wall surrounds and is connected to a periphery of the air inlet top wall, wherein the air guide side wall passes through the mounting opening such that the air inlet top wall protrudes from the bottom wall of the holder, wherein the flange is connected to a periphery of the air guide side wall and extends outward, and wherein the flange is clamped between the bottom wall of the base and the bottom wall of the holder.

5. The vaporizer of claim 4, further comprising:

on the bottom wall of the base, a first buffer groove, the first buffer groove surrounding the vent hole; and a liquid absorbing member, the liquid absorbing member being pressed by the holder and disposed in the first buffer groove, the liquid absorbing member being disposed surrounding the flange and in contact with the flange.

6. The vaporizer of claim 5, further comprising:

on the bottom wall of the base, a second buffer groove, the second buffer groove being disposed at a bottom wall of the first buffer groove.

7. The vaporizer of claim 3, further comprising:

a receiving groove on the bottom wall of the base, the receiving groove corresponding to the mounting opening and being configured to receive liquid leaked from at least one run-through air inlet hole of the plurality of run-through air inlet holes.

8. The vaporizer of claim 2, further comprising:

a vaporization sleeve comprising a liquid storage cavity; and a mounting base comprising a first pressure regulating channel and a liquid inlet cavity, wherein the first pressure regulating channel is circuitously provided at a periphery of the liquid inlet cavity, wherein the mounting base is embedded in the liquid storage cavity, wherein the first pressure regulating channel and the liquid inlet cavity are both in communication with the liquid storage cavity, wherein the first pressure regulating channel is in communication with air, and wherein the vaporization core is further connected to one end of the mounting base away from the liquid storage cavity so as to block the liquid inlet cavity.

9. The vaporizer of claim 8, wherein the first pressure regulating channel comprises a liquid inlet groove, at least one liquid storage groove, and a vent groove that are in communication with each other sequentially, wherein the at least one liquid storage groove comprises a plurality of liquid storage grooves, each liquid storage groove of the plurality of liquid storage grooves being arranged on a side wall of the mounting base in an embedding direction of the mounting base facing the liquid storage cavity, wherein the plurality of liquid storage grooves are in communication with each other, wherein the liquid inlet groove communicates the liquid storage cavity with the plurality of liquid storage grooves, and wherein the vent groove communicates the plurality of liquid storage grooves with air.

10. The vaporizer of claim 9, wherein two adjacent liquid storage grooves of the plurality of liquid storage grooves are in communication through a notch, and adjacent notches are respectively located on two ends of a respective liquid storage groove.

11. The vaporizer of claim 9, further comprising:

a first seal member disposed between the side wall of the mounting base and a side wall of the vaporization sleeve, the first seal member blocking one side of the liquid inlet groove, the liquid storage groove, and the vent groove facing a side wall of the liquid storage cavity.

12. The vaporizer of claim 11, wherein the first seal member comprises:

a side wall seal portion;

an end surface cover portion; and a sleeve seal portion, the side wall seal portion being connected to an outer periphery of the end surface cover portion and to an inner periphery of the end surface cover portion, wherein the side wall seal portion and the sleeve seal portion are disposed in a nested manner, wherein the side wall seal portion is sleeved on the mounting base and disposed between the side wall of the mounting base and the side wall of the vaporization sleeve, wherein the end surface cover portion is covered on one end of the mounting base facing the liquid storage cavity, wherein a first avoidance opening and a second avoidance opening are provided on the end surface cover portion, the first avoidance opening corresponding to an end opening of the liquid inlet groove, wherein the mounting base further comprises a liquid inlet cavity, the liquid inlet cavity being in communication with the liquid storage cavity, wherein the second avoidance opening corresponds to an end opening of the liquid inlet cavity, wherein a vapor outlet is further provided on one side of the mounting base facing the liquid storage cavity, wherein the sleeve seal portion is embedded in the vapor outlet, and wherein a vent tube is disposed in the vaporization sleeve, the vent tube being connected to the vapor outlet.

13. The vaporizer of claim 8, further comprising:

an access cavity on one end of the mounting base away from the liquid storage cavity, the access cavity being in communication with the liquid inlet cavity; and a second seal member sleeved on the vaporization core and embedded in the access cavity along with the vaporization core.

14. The vaporizer of claim 13, wherein the holder is connected to the mounting base and engages with the mounting base to clamp and fix the vaporization core.

15. The vaporizer of claim 14, wherein the mounting base comprises a barb, wherein a first barb hole is provided on the holder, wherein a second barb hole is provided on the base, and wherein the barb is connected to both the first barb hole and the second barb hole in a hooked manner.

16. The vaporizer of claim 8, further comprising:

a vapor outlet on one side of the mounting base facing the liquid storage cavity, wherein a vent tube is disposed in the vaporization sleeve, the vent tube being connected to the vapor outlet, wherein the vaporization core is configured to form liquid flowing in through the liquid inlet cavity into vapor in the second cavity, and wherein the vapor outlet is in communication with the second cavity.

17. The vaporizer of claim 8, wherein the base sealedly covers one end of the vaporization sleeve and is connected to the mounting base, and wherein the base comprises a second pressure regulating channel, the second pressure regulating channel being circuitous and in communication with both the first pressure regulating channel and the second cavity.

18. An electronic vaporization device, comprising:

a body component; and the vaporizer of claim 1, wherein the body component is connected to the vaporizer and is configured to supply power to the vaporizer.

* * * * *